US006394068B1

(12) United States Patent
Palotay

(10) Patent No.: US 6,394,068 B1
(45) Date of Patent: May 28, 2002

(54) THROTTLE SHAFT AND PLATE ASSEMBLY

(76) Inventor: Zoltan Palotay, 248 Taylor St., Harrow Ontario (CA)

( * ) Notice: Subject to any disclaimer, the term of this patent is extended or adjusted under 35 U.S.C. 154(b) by 0 days.

(21) Appl. No.: 09/656,806

(22) Filed: Sep. 7, 2000

Related U.S. Application Data

(60) Provisional application No. 60/152,792, filed on Sep. 8, 1999.

(51) Int. Cl.[7] ..... F02D 9/08
(52) U.S. Cl. ..... 123/337; 251/305
(58) Field of Search ..... 123/337; 251/305

(56) References Cited

U.S. PATENT DOCUMENTS 184,255 A * 11/1876 Mears ..... 251/305
3,381,935 A * 5/1968 Middler ..... 251/305

* cited by examiner

*Primary Examiner*—John Kwon

(57) ABSTRACT

A throttle assembly includes a throttle plate that is mounted for rotation with a throttle shaft. A first set of ribs is formed along a portion of the throttle shaft and a second set of ribs is formed along one side of the throttle plate. The throttle shaft includes a D-shaped boss that is received within a D-shaped opening in the throttle plate to properly locate the plate to the shaft. When the plate is properly positioned, the second set of ribs is positioned transversely with respect to the first set of ribs and abuts against the first set of ribs. Weld energy is supplied along the length of the rib interface to secure the plate to the shaft.

16 Claims, 1 Drawing Sheet

THROTTLE SHAFT AND PLATE ASSEMBLY

RELATED APPLICATION

This application claims priority to provisional application No. 60/152,792 filed on Sep. 8, 1999.

BACKGROUND OF THE INVENTION

1. Field of the Invention

This invention relates to a method and apparatus for attaching a throttle plate to a throttle shall for an automotive engine.

2. Related Art

An engine throttle valve is installed in a throttle body receiving inlet that receives air flow from an intake manifold. The throttle valves typically have a throttle plate disc that is attached to a throttle shaft that is mounted to extend across the bore of the inlet. The throttle shaft is used to rotate the throttle plate to variably control air flow within the bore.

Usually the throttle plate and the throttle shaft are constructed of metal and are attached to each other with screws or other fasteners. The fasteners can loosen over time and be drawn into the engine causing damage. The use of fasteners also increases assembly time and cost.

Another attachment method uses ultrasonic heat staking to attach a plastic throttle plate to a plastic throttle shaft. The shaft has bosses that are received in openings formed on the plate. Ultrasonic staking causes localized melting that secures the bosses to the plate. This attachment method can fail due to the small area of contact between the boss and the plate.

It is the object of the present invention to provide an improved throttle shaft and plate assembly that eliminates the use of fasteners and provides a more secure attachment between the throttle plate and shaft.

SUMMARY OF THE INVENTION

In a disclosed embodiment of this invention, a throttle assembly includes a throttle shaft and a throttle plate. The throttle shaft defines a longitudinal axis and is formed with a flat surface extending partially along the length of the shaft. A first set of ribs is supported on the flat surface. The ribs are positioned in a transverse relationship lo the longitudinal axis. The throttle plate has a body with a locating portion that properly positions the plate with respect to the shaft. A second set of ribs is supported on one side of the body. The second set of ribs is positioned transversely to and in abutting engagement with the first set of ribs when the locating portion engages the shaft. The first and second sets of ribs are welded together to secure the plate to the shaft.

In a preferred embodiment, the throttle plate and shaft are formed from a non-metallic material. The first set of ribs is integrally formed with the shaft as one piece and the second set of ribs is integrally formed with the plate as one piece. Preferably the second set of ribs is perpendicular to the first set of ribs and the first set of ribs is perpendicular to the longitudinal axis.

In one embodiment, the shaft includes a boss formed in a first predetermined shape that projects from the shaft. The locating portion is preferably a hole formed within the plate body and has a second predetermined shape that corresponds to the first predetermined shape. The boss is inserted into the hole to locate the plate with respect to said shaft.

A method for assembling the throttle plate to the throttle shaft includes the following steps. A first plurality of ribs is formed on the throttle shaft and a second plurality of ribs is formed on the throttle plate. The throttle plate is located with respect to the throttle shaft and the second plurality of ribs is abutted against the first plurality of ribs. The throttle plate is attached to the throttle shaft by supplying weld energy along the interface between the first and second plurality of ribs.

The subject apparatus and method of assembly provide a simplified attachment process that eliminates components and reduces assembly time and cost. The inventive apparatus and method of assembly also provides a secure and enduring connecting between the throttle shaft and plate.

These and other features of the present invention can be best understood from the following specification and drawings, the following of which is a brief description.

DETAILED DESCRIPTION OF AN EXEMPLARY EMBODIMENT

Figure 1:
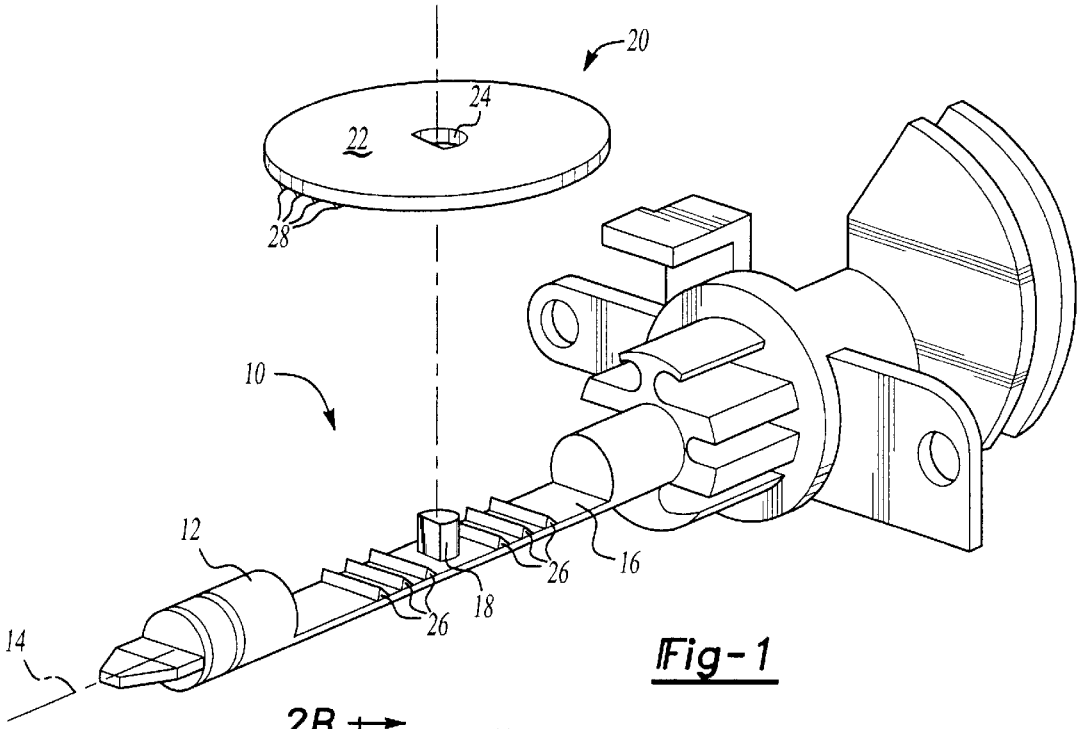
FIG. 1 an exploded perspective view of a throttle shaft and throttle plate.

Referring to the drawings, a throttle shaft assembly is shown generally at 10 in FIG. 1. The assembly 10 includes a throttle shaft 12 that is preferably formed integrally with other components such as the spring retainer and lever. The throttle shaft assembly is preferably formed by injection molding a composite plastic or other non-metallic material. The material selected should be able to sustain sufficient weld energy used during the assembly process. This will be discussed in further detail below.

The throttle shaft 12 defines a longitudinal axis 14 and has a recess formed along one side that presents a generally flat surface 16. A boss 18 projects outwardly from the flat surface 16 and is preferably integrally formed with the shaft 12 as one piece.

A throttle plate 20 formed in the shape of disc is mounted for rotation with the shaft 12. The plate 20 has a body 22 with a hole 24 extending through the body 22 that receives the boss 18. Preferably, the boss 18 is D-shaped with a flat edge and a rounded edge. The hole 24 is formed in the same shape as the boss 18 so that the boss 18 is easily and accurately aligned within the hole 24 when the plate 20 is inserted on the shaft 12. While a D-shape is preferred, it should be understood that other shapes could also be used.

Figure 2A:
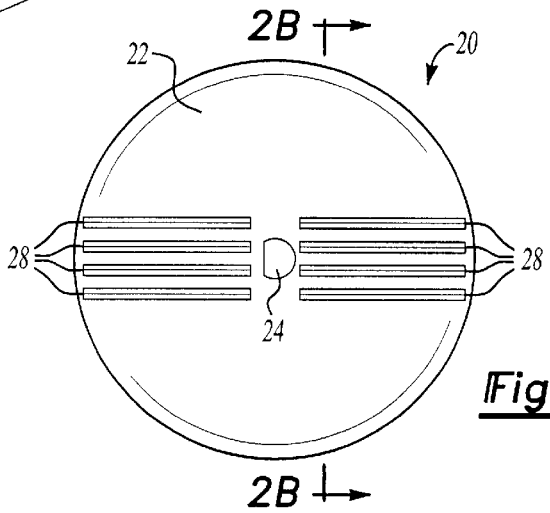
FIG. 2A bottom view of the throttle plate of FIG. 1.

A first set of energy directors 26 are formed on the flat surface 16 of the shaft 12. Preferably, the energy directors 26 are a set of raised ribs 26. The ribs 26 extend outwardly from the surface 16 and are orientated transversely to the longitudinal axis 14, however, other rib orientations could also be used. A second set of energy directors 28 are formed on one side 30 of the plate 20, shown in FIG. 2A. Preferably, the energy directors 28 are a set of raised ribs 28. The second set of ribs 28 extend outwardly from the body 22 and are orientated transversely to the first set of ribs 26 when the boss 18 is inserted into the hole 24. In the preferred embodiment, the first set of ribs 26 are perpendicular to the longitudinal axis 14 and the second set of ribs 28 are perpendicular to the first set of ribs 26.

Figure 2B:
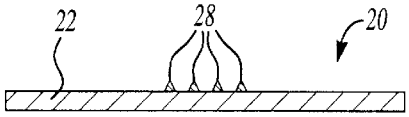
FIG. 2B is a cross-sectional view of the throttle plate of FIG. 1 taken along lines 2B—2B.

The ribs 26 and 28 are preferably triangular in shape, see FIG. 2B. Other shapes could be used such as half-round, square, or other polygonal configurations. The ribs 28 on the plate 20 are located on either side of the centrally located hole 24 and extend in a linear direction from the hole 24 toward the edge of the plate 20. Preferably, at least four (4) ribs 28 are positioned on either side of the hole 24. The ribs 26 on the shaft 12 are located on either side of the boss 18 and extend in a linear direction from one edge of the flat surface 16 to the opposite edge. Preferably, at least three (3) ribs 26 are positioned on either side of the boss 18.

Figure 3:
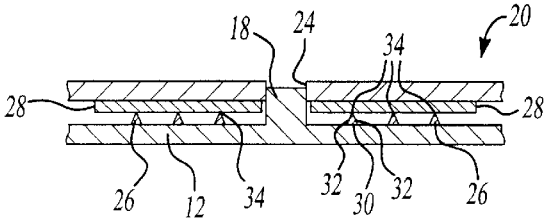
FIG. 3 is an enlarged fragmentary view of a lengthwise section taken through an assembled throttle shaft and plate prior to welding.

The ribs have a base portion 30 and an angled pair of sides 32 that extend upwardly to a tip 34. When the boss 18 is received in the hole 24, the second set of ribs 28 abuts against the first set of ribs 26 creating point to point contact along the length of the ribs 26, 28, shown in FIG. 3. Weld energy is directed across the shaft 12 using the energy directors 26, 28, which results in a weld being formed along the entire length of the ribs 26, 28. The point-to-point contact between the ribs 26 of the shaft 12 and the ribs 28 of the plate 20 concentrates the weld energy and improves the weld strength of the connection between the plate 20 and the shaft 12. The welding process is well known in the art and will not be discussed in detail.

Figure 4:
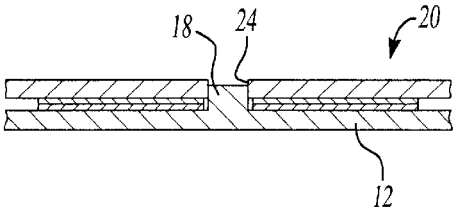
FIG. 4 is an enlarged fragmentary view of a lengthwise section taken through the assembled throttle shaft and plate subsequent to welding.

The shaft 12 and the plate 20 are preferably formed from a non-metallic material, such as plastic. The first set of ribs 26 is preferably integrally formed with the shaft 12 as one piece and the second set of ribs 28 is preferably integrally formed with the plate 20 as one piece in an injection molding process. When the weld energy is applied along the ribs 26, 28, localized melting occurs at the rib interface causing the plate 20 to be securely attached to the shaft 12, shown in FIG. 4.

The method for assembling the throttle plate 20 to the throttle shaft 12 includes the following steps. The first set of ribs 26 is formed on the throttle shaft 12 and the second set of ribs 28 is formed on the throttle plate 20. The throttle plate 20 is located with respect to the throttle shaft 12 via the boss 18 and the hole 24 formed in the plate 20. The second set of ribs 28 is placed in abutting engagement with the first set of ribs 26 and the throttle plate 20 is attached to the throttle shaft 12 by supplying weld energy along the interface between the first 26 and second 28 set of ribs.

Additional steps include, positioning the second set of ribs 28 transversely with respect to the first set of ribs 26 and positioning the second set of ribs 28 perpendicularly with respect to the first set of ribs 26.

Although a preferred embodiment of this invention has been disclosed, it should be understood that a worker of ordinary skill in the art would recognize many modifications come within the scope of this invention. For that reason, the following claims should be studied to determine the true scope and content of this invention.

What is claimed is:

1. A throttle assembly comprising:

a throttle shaft defining a longitudinal axis and being formed with a flat surface extending partially along the length of said shaft, a first plurality of ribs supported on said flat surface;

a throttle plate having a main body with a locating portion that mates with said shaft to locate said plate with respect to said shaft during assembly; and a second plurality of ribs supported on one side of said main body and positioned to butt against and extend transversely with respect to said first plurality of ribs when said locating portion mates with said shaft, said second plurality of ribs being welded to said first plurality of ribs to secure said plate to said shaft.

2. An assembly according to claim 1 wherein first plurality of ribs extends transversely with respect to said longitudinal axis.

3. An assembly according to claim 1 wherein said second plurality of ribs is perpendicular to said first plurality of ribs.

4. An assembly according to claim 3 wherein said first plurality of ribs is perpendicular to said longitudinal axis.

5. An assembly according to claim 1 including a boss formed in a first predetermined shape projecting from said flat surface and wherein said locating portion is a hole formed within said main body having a second predetermined shape that corresponds to said first predetermined shape, said boss being received in said hole to locate said plate with respect to said shaft.

6. An assembly according to claim 1 wherein said first and second plurality of ribs have a triangular cross-section.

7. An assembly according to claim 1 wherein said throttle plate and said throttle shaft are formed from a non-metallic material.

8. An assembly according to claim 1 wherein said first plurality of ribs are integrally formed with said shaft as one piece and said second plurality of ribs are integrally formed with said plate as one piece.

9. A method for assembling a throttle plate to a throttle shaft comprising the steps of:

(a) forming a first plurality of ribs on the throttle shaft;

(b) forming a second plurality of ribs on the throttle plate;

(c) locating the throttle plate with respect to the throttle shaft;

(d) abutting the second plurality of ribs against the first plurality of ribs; and (e) supplying weld energy along the interface between the first and second plurality of ribs to attach the throttle plate to the throttle shaft.

10. A method according to claim 9 wherein step (d) includes positioning the second plurality of ribs transversely to the first plurality of ribs.

11. A method according to claim 10 including the step of positioning the second plurality of ribs perpendicularly with respect to the first plurality of ribs.

12. A method according to claim 9 wherein step (c) includes forming a boss having a first predetermined shape on the shaft, forming a hole in the throttle plate having a second predetermined shape that corresponds to the first predetermined shape, and inserting the boss into the hole.

13. A method according to claim 9 wherein steps (a) and (b) include forming the first and second plurality of ribs with a triangular cross-section.

14. A method according to claim 9 wherein steps (a) and (b) include forming the throttle shaft and plate from a non-metallic material.

15. A method according to claim 10 wherein steps (a) and (b) include integrally forming the first plurality of ribs with the throttle shaft as one piece and integrally forming the second plurality of ribs with the throttle plate as one piece.

16. A method according to claim 9 wherein the throttle shaft defines a longitudinal axis and step (a) includes forming the first plurality of ribs in a perpendicular relationship to the longitudinal axis.

* * * * *